United States Patent [19]

Kortick

[11] 3,930,577

[45] Jan. 6, 1976

[54] DISPLAY CONTAINER

[76] Inventor: Leonard R. Kortick, 88 Waldron Ave., Cranston, R.I. 02907

[22] Filed: Sept. 30, 1974

[21] Appl. No.: 510,407

Related U.S. Application Data

[63] Continuation-in-part of Ser. No. 133,852, April 14, 1971, abandoned.

[52] U.S. Cl. ..... 206/45.13; 206/45.15; 206/45.18; 220/350

[51] Int. Cl.[2] ..... B65D 79/00; B65D 43/20

[58] Field of Search .... 206/45.13, 45.15, 75, 45.18; 220/350, 345; 217/63, 62

[56] References Cited

UNITED STATES PATENTS

| | | | |
|---|---|---|---|
| 371,182 | 10/1887 | Evans | 206/45.13 |
| 416,552 | 12/1889 | Bique | 206/45.13 |
| 1,107,985 | 8/1914 | Moskowitz | 206/45.19 |
| 1,527,356 | 2/1925 | Glauser et al. | 206/45.13 UX |
| 1,651,804 | 12/1927 | Bosch | 206/45.15 |
| 2,880,858 | 4/1959 | Persky | 206/45.13 |
| 3,316,656 | 5/1967 | Wahl | 220/345 X |

FOREIGN PATENTS OR APPLICATIONS

| | | | |
|---|---|---|---|
| 165,734 | 4/1950 | Austria | 206/45.13 |
| 912,250 | 4/1946 | France | 206/45.13 |
| 773,233 | 4/1957 | United Kingdom | 206/45.13 |

*Primary Examiner*—Leonard Summer
*Attorney, Agent, or Firm*—Max Schwartz

[57] ABSTRACT

A display container comprising a molded plastic base having spaced elongated oval sides tapering to a open curved front end and a larger curved rear end. A bottom wall extends integrally from the periphery of the sides in a continuous length from a point on the top adjacent the front, around the front end, along the bottom, around the rear end, and on to the top. The opening extends from the front to the rear edge of this wall. The sides have opposed grooves extending adjacent the edges. A plastic flexible cover is slidably mounted in the grooves so that when it is pulled forwardly against the front edge of the wall, the container is closed, and when it is pushed rearwardly, the container is opened. An elongated bar is pivotally mounted adjacent the front end. A support extends from the bar designed to hold an article, such as a travel clock, or a watch, for display. The grooves are curved forwardly and upwardly to direct the rear edge of the cover against the support adjacent the pivot bar when the cover is pushed rearwardly to opne the container. This will tilt the bar and support upwardly to display the contents in a tilted position. When the cover is moved toward closed position the support drops back into the container.

7 Claims, 12 Drawing Figures

DISPLAY CONTAINER

BACKGROUND OF THE INVENTION

The present application constitutes a continuation in part of applicant's application Ser. No. 133,852, filed Apr. 14, 1971, and entitled Display Container, now abandoned.

Shipping and display containers are conventionally made in a variety of materials such as paper, cardboard, wood, plastic, etc. They usually provide for the removal of the cover and some means of tilting the base to display the goods. Where such types of containers are used for holding the goods, as for travel, manual means are provided for displaying the contents or removing it from the container.

SUMMARY OF THE INVENTION

The present invention is designed to provide a container in which the cover is used to push the contents into a display position. A molded plastic case comprises spaced oval sides and a wall extending from the front, around the bottom, to the rear, defining an opening at the top. The sides are provided with opposed grooves adjacent the edges and a flexible plastic cover slides in the grooves. A pivot member is mounted in the container adjacent the front end, the member carrying a support for holding the contents in horizontal position. When the cover is pushed rearwardly to open the container, the rear edge of the cover is directed forwardly and upwardly by curves in the grooves to contact and tilt the support into a display position. This action of the cover occurs after additional movement following the opening of the container. When the cover is closed, the support is released and the contents drops back into the container in horizontal position.

DESCRIPTION OF THE INVENTION

Figure 1:
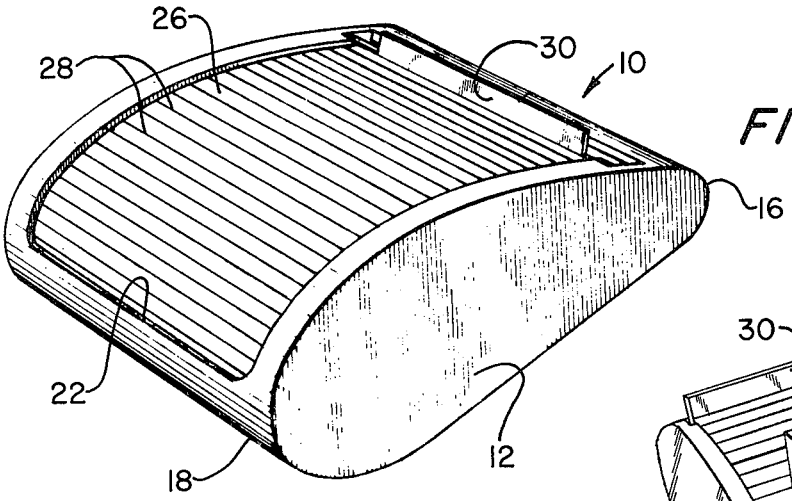
FIG. 1 is a perspective view of a display container embodying my present invention.

Referring more in detail to the drawings illustrating my invention, FIGS. 1 to 4, inclusive, show a basic container with one method of displaying the goods.

This form illustrates the container with a travel clock. The container 10 comprises a molded plastic housing integrally formed with spaced oval sides 12 connected by the integral wall 14. The container 10 tapers toward the front end 16 in a narrow curve and sweeps upwardly toward the rear to a larger curved rear end 18. The container opening extends from the front edge 20 of the wall 14 to the rear edge 22 of the wall 14.

Figure 4:
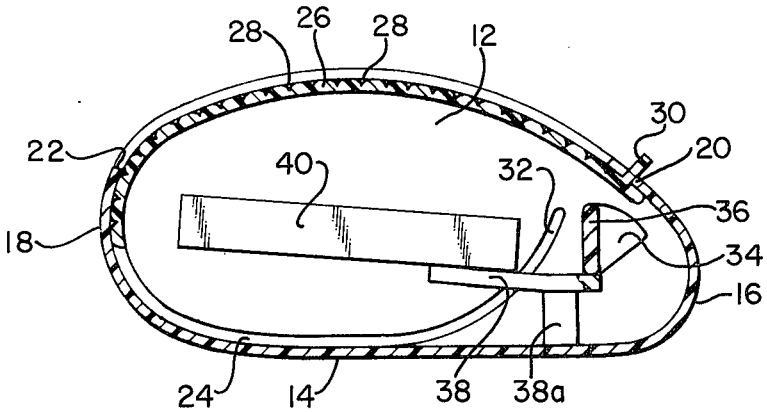
FIG. 4 is a longitudinal section of the container, without the travel clock, in closed position.

The sides 12 are provided with opposed grooves 24 extending around the opposed faces of the sides adjacent the perimeters, see FIG. 4. The cover 26 comprises a rectangular flexible strip of plastic material having spaced grooves 28 extending transversely to provide a thin flexible web portion between thicker portions. This gives a reticulated effect and allows the cover to swing around the rear curved end 18. The cover 26 is slidably mounted in the grooves 24 and is provided with an integral vertical front end 30 which is manually engageable to slide the cover. The end 30 also serves as a stop to limit the movement of the cover 26. In FIG. 4 the cover 26 is in closed position and the portion 30 abuts the front edge 20 of the wall 14. In open position, the portion 30 abuts the rear edge 22 of the wall 14. As can be seen in FIG. 4, the grooves 24 extend adjacent the edges of the sides 12 around the rear end 18, along the bottom toward the front end, then curving forwardly and upwardly at 32 to terminate short of the pivot bar hereinafter described. The cover 26 slides along these grooves into open and closed position.

Adjacent the front end, the opposed side walls 12 are provided with sector-shaped recesses 34. A flat elongated rectangular bar 36 is loosely mounted in the recesses 34 so that it can pivot from the vertical position shown in FIG. 4 to a slanted position against the front walls of the recesses 34. A short supporting plate 38 extends horizontally from the bottom edge of the bar 36 toward the rear. A rectangular frame 40 is mounted on the plate 38 and extends longitudinally into the container. In closed position, the bottom of the support plate 38 is provided with a vertical block 38a which rests on the bottom to hold the plate 38 and frame 40 in horizontal position. A rectangular travel clock 42 is frictionally mounted in the frame 40, the plate 38 acting as a stop to prevent the clock from being pushed through the frame.

Figure 3:
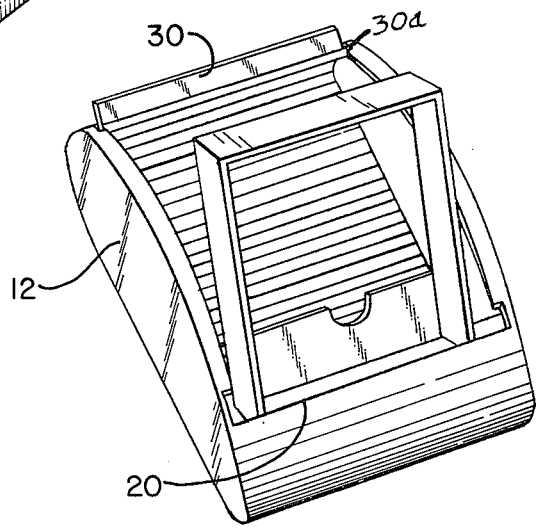
FIG. 3 is a view identical to FIG. 2 with the travel clock removed.
Figure 2:
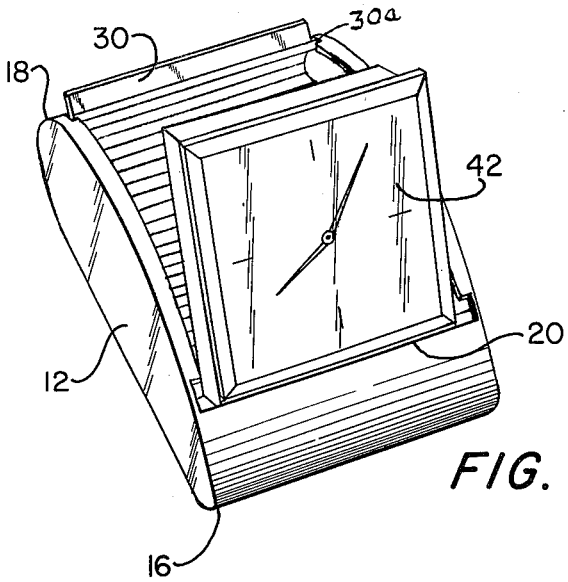
FIG. 2 is a perspective view of the container in open position with a travel clock held in tilted position.

Now when the cover 26 is pushed rearwardly, the container is opened and the clock 42 is visible. The cover 26 slides in the grooves 24 until it reaches the upturned end 32 of the grooves. At this point the container is open but the cover 26 has room to move rearwardly against the edge 22 of the wall 14. This last short movement causes the rear end of the cover 26 to engage the bottom of the plate 38 and pivot it upwardly until the pivot bar 36 swings against the forward walls of the recesses 34. FIGS. 2 and 3 show the tilted position which displays the travel clock 42 for convenient viewing on a night table or stand. When the edge member 30 of the cover is moved forwardly, the initial movement will allow the clock and support to swing back into the container in horizontal position. This clears the path of the cover which can now be pulled into closed position. The weight of the clock 42 may tend to force the cover back from the tilted position. To prevent this, the edge of the sides 12 may be notched at 30*a* to releasably retain the member 30, and the cover 26, in open position.

The above construction illustrates the basic principles of the present invention as applied, for illustrative purposes, to a travel clock. Any other desired article can readily be mounted on the frame 40, and the container can be used for a shipping and display container for displaying goods on the counter.

Figure 5:
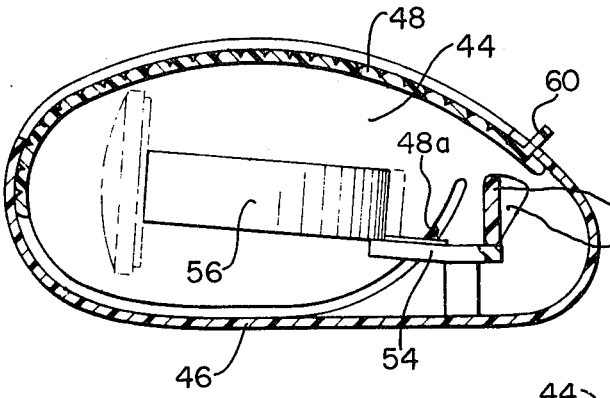
FIG. 5 is a view similar to FIG. 4 with a watch holding support.
Figure 6:
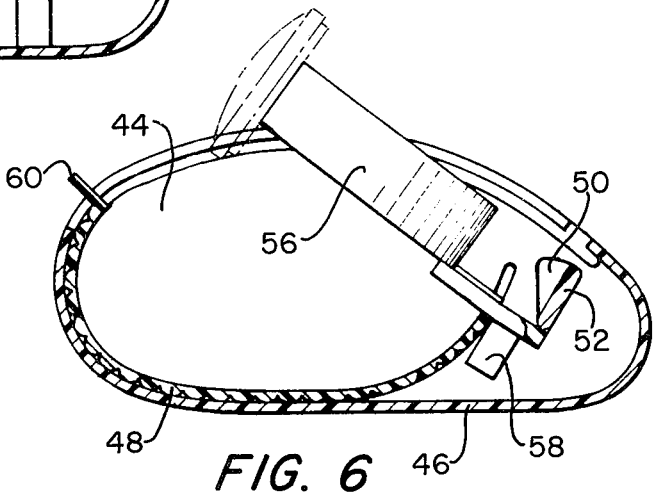
FIG. 6 is a view similar to FIG. 5 with the cover in open position and the support in display position.
Figure 7:
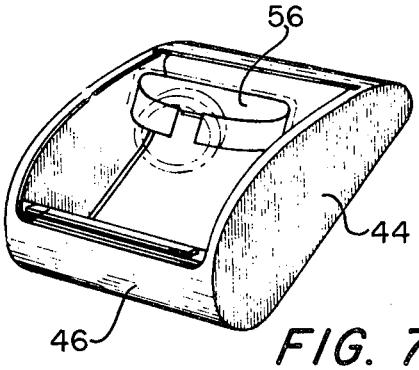
FIG. 7 is a perspective view of the container as shown in FIG. 6.

For example, FIGS. 5, 6 and 7 illustrate another way of displaying a flexible bracelet or watch and band in the basic container. This form is similar to the one shown in FIG. 1. It has oval sides 44, the integral wall 46, and flexible cover 48. As in the previous form, a pair of opposed sector-shaped recesses 50 are positioned adjacent the front of the sides 44. The pivot bar 52 is mounted in the recesses, and the support plate 54 extends horizontally from the bottom edge of the bar 52. In this form, an annular holder 56, having a gap for spring flexibility in the conventional manner, extends into the container from the support plate 54. The plate 54 has a vertical block 58 to keep the parts in horizontal position, FIG. 5.

Now, when the cover is pushed open, the contents will become visible, such as a watch band shown in dotted lines. The final movement of the cover 48 will cause it to engage the plate 54, FIG. 6, to tilt the support and watch into display position, FIGS. 6 and 7. In both forms, the initial closing movement of the cover allows the support to resume its horizontal position in the container and leaves the opening clear for the closing movement of the cover.

Figure 8:
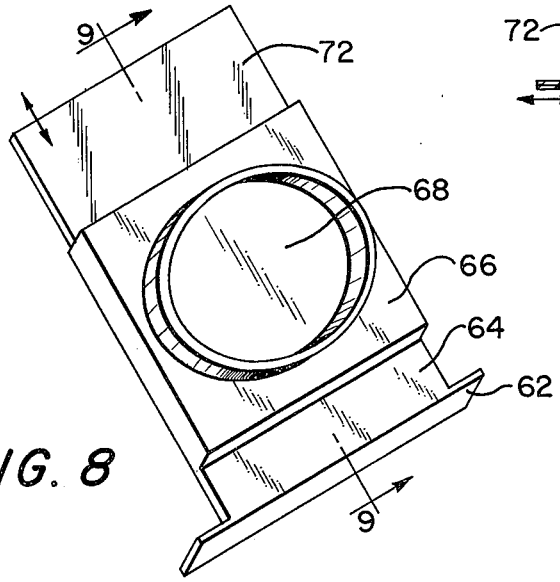
FIG. 8 is a perspective view of another type of support for the display container.
Figure 9:
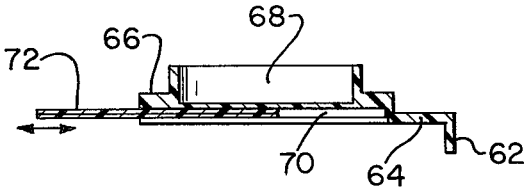
FIG. 9 is a section taken on line 9-9 on FIG. 8.
Figure 10:
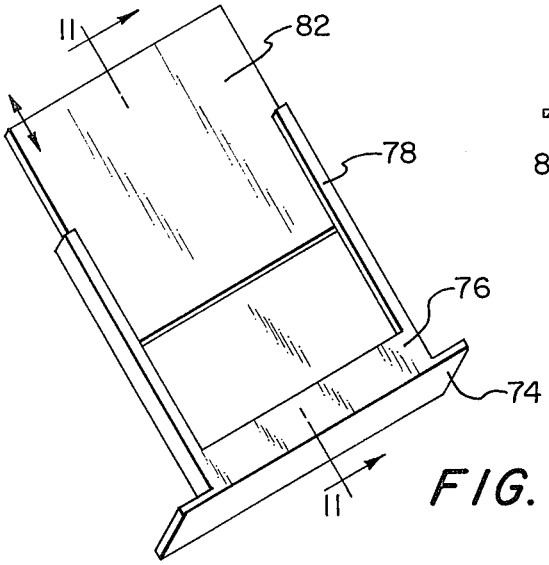
FIG. 10 is a perspective view of still another type of support for the container.
Figure 11:
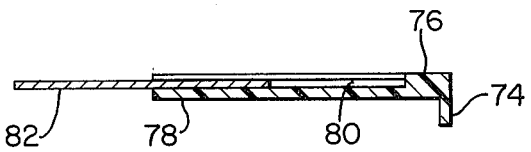
FIG. 11 is a section taken on line 11-11 on FIG. 10.

Thus the function and utility of the container can be altered by the character of the support. In the form shown in FIGS. 8 and 9, a pivot bar 62 is provided with an integral horizontal portion 64 extending from its top edge. A flat rectangular housing 66 extends integrally from the portion 64 and is provided on its top face with an annular socket portion 68 into which an annular travel clock or similar article may be mounted. Beneath the portion 68, the spaced side walls are provided with opposed grooves 70 in which one or more supports 72 may be inserted. The supports 72 may carry snapshots, etc., for viewing when the clock has been tilted into view. In the form shown in FIGS. 10 and 11, the clock has been eliminated. Here the pivot bar 74 has the integral horizontal support 76 extending from the top edge. Spaced integral arms 78 extend from the support 76 and are provided with opposed grooves 80. A rectangular supporting plate 82 is slidably mounted in the grooves 80. With this construction, any desired item of merchandise can be mounted on the plate 82 and displayed in tilted position and even removed by sliding the plate 82 out of the grooves 80.

Figure 12:
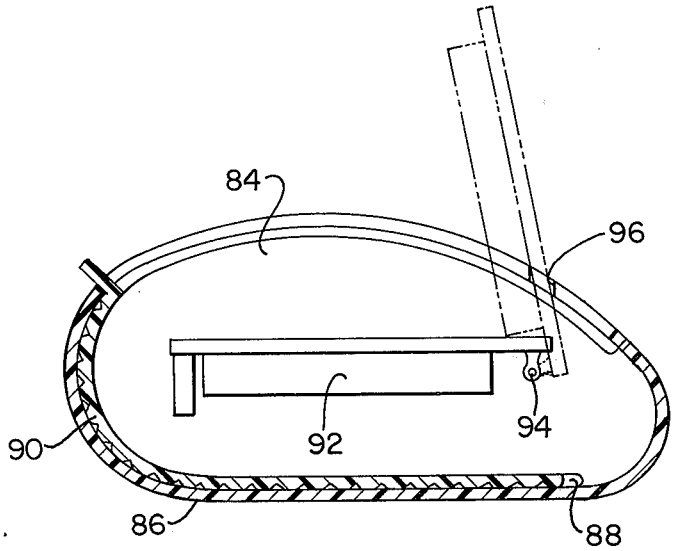
FIG. 12 is a longitudinal section of an alternative display form for the container.

Finally, the container can be used with a travel clock or the like where the tilting action is manually performed directly on the support. FIG. 12 illustrates a construction in which the container is formed with the sides 84, wall 86, grooves 88 and cover 90. In this form the grooves 88 extend straight along the bottom without a curvature so that there is no contact with the supporting plate. The supporting plate 92 is pivoted at 94. The edges of the sides 84, spaced from the front end, are provided with notches 96 for releasably holding the support 92 in raised position, (dotted lines). By allowing the support 92 to frictionally engage the edges of the sides 84, a frictional locking action is created. The travel clock can be positioned on the support plate 92 and manually raised and lowered when needed.

I have thus provided a novel display container having a self contained cover which can be used to tilt the contents of the container into display position. Manufacturing is simple because the basic container can readily be altered by changing the supports only. Other advantages of the present invention will be readily apparent to a person skilled in the art.

I claim:

1. A display container comprising a rigid plastic housing having spaced parallel elongated oval sides and a wall portion extending along the bottom perimeter of said sides, the front end of said wall portion extending around the front of said oval sides and partially along the top, the rear end of said wall portion extending upwardly at the rear of said oval sides, the space between the front and rear ends of said wall portion forming the container top opening, opposed grooves extending around the inside of said sides adjacent the perimeter, a plastic cover slidable in said grooves and having transverse grooves forming thin web portions to impart flexibility to said cover, said cover being slidable rearwardly to open said container and being slidable forwardly to close said container, and an article display means pivotally mounted in said container, said pivotal mounting being between said side walls adjacent the front end of said container, the inner ends of said grooves curving forwardly and upwardly adjacent and rearwardly of the pivotal mounting of said display means, said cover being of such length that the rear end of said cover will engage said display means adjacent said pivotal mounting only after said cover has been slid rearwardly to open position with the front edge of said cover spaced forwardly from the rear edge of said wall portion, whereby final movement of the front edge of said cover rearwardly toward the rear edge of said wall portion will cause the rear end of said cover to pivot said display means into raised position.

2. A display container as in claim 1, wherein said display means is provided with a vertical support extending downwardly to rest on the bottom of said housing for maintaining said said display means in horizontal position.

3. A display container as in claim 1, wherein said pivotal mountings are opposed sector-shaped recesses adjacent the front end, the apex of each sector-shaped recess being pointed toward the bottom of the container, a flat bar loosely mounted in said recesses for pivotal movement from one straight side to the other straight side of each recess, and said display means extending at right angles from said flat bar.

4. A display container as in claim 3, wherein said display means includes a frame member extending from said flat bar, whereby a travel clock may be frictionally held in said frame member.

5. A display container as in claim 4, wherein said display means includes an annular watch band holder mounted on said display means, whereby a wrist watch may be mounted on said holder.

6. A display container as in claim 4, wherein said display means includes a rectangular base extending from said flat bar, means for frictionally mounting a travel clock on the upper face of said base, and means for slidably mounting photographs or the like on the under side of said base.

7. A display container as in claim 4, wherein said display means includes a pair of spaced arms extending from said flat bar, opposed grooves on said arms, and an article supporting plate slidable in said grooves.

* * * * *